US010328998B2

(12) United States Patent
Nordemar

(10) Patent No.: US 10,328,998 B2
(45) Date of Patent: Jun. 25, 2019

(54) DINGHY SUPPORT ARRANGEMENT

(71) Applicant: DINGHY RINGS SWEDEN AKTIEBOLAG, Sollentuna (SE)

(72) Inventor: Johannes Nordemar, Sollentuna (SE)

(73) Assignee: DINGHY RINGS SWEDEN AB, Sollentuna (SE)

( * ) Notice: Subject to any disclaimer, the term of this patent is extended or adjusted under 35 U.S.C. 154(b) by 0 days.

(21) Appl. No.: 15/736,643

(22) PCT Filed: Jul. 7, 2016

(86) PCT No.: PCT/SE2016/000039
§ 371 (c)(1),
(2) Date: Dec. 14, 2017

(87) PCT Pub. No.: WO2017/007390
PCT Pub. Date: Jan. 12, 2017

(65) Prior Publication Data

US 2018/0186435 A1 Jul. 5, 2018

(30) Foreign Application Priority Data

Jul. 7, 2015 (SE) ..... 1530106

(51) Int. Cl.

| | |
|---|---|
| ***B63B 17/00*** | (2006.01) |
| ***B63B 23/62*** | (2006.01) |
| ***B63B 23/32*** | (2006.01) |
| *B63B 21/58* | (2006.01) |
| *B63B 29/02* | (2006.01) |
| *B63B 27/36* | (2006.01) |

(52) U.S. Cl.
CPC ..... *B63B 23/62* (2013.01); *B63B 23/32* (2013.01); *B63B 27/36* (2013.01); *B63B 2029/022* (2013.01)

(58) Field of Classification Search
CPC ..... B63B 23/32; B63B 23/38; B63B 23/62; B63B 23/64; B63B 23/66; B63B 23/68; B63B 23/70
USPC ..... 114/343, 344, 364
See application file for complete search history.

(56) References Cited

U.S. PATENT DOCUMENTS

| | | | | | |
|---|---|---|---|---|---|
| 4,964,358 | A * | 10/1990 | Sandrow | B63B 23/32 | 114/365 |
| 5,170,742 | A * | 12/1992 | Roskelley | B63B 23/10 | 114/366 |
| 5,193,479 | A * | 3/1993 | Bielefeld | B63B 23/32 | 114/259 |
| 5,937,783 | A * | 8/1999 | Costa | B63B 23/30 | 114/259 |

(Continued)

*Primary Examiner* — Daniel V Venne
(74) *Attorney, Agent, or Firm* — Fasth Law Offices; Rolf Fasth

(57) ABSTRACT

A support arrangement for supporting a dinghy on a carrier boat. The support arrangement has a base structure for attachment to the carrier boat and two carrying members for receiving a dinghy having two rear conical pontoon ends pointing in the same direction. The two carrying members are rotatably arranged with respect to the base structure along the longitudinal axis of the base structure such that the dinghy can be moved between a substantially horizontal orientation and an upright orientation with the conical pontoon ends received in the respective carrying member.

4 Claims, 4 Drawing Sheets

(56) References Cited

U.S. PATENT DOCUMENTS 6,782,842 B1 * 8/2004 Alvord ..... B63B 27/16
114/259

* cited by examiner

DINGHY SUPPORT ARRANGEMENT

PRIOR APPLICATIONS

This is a US national phase patent application that claims priority from PCT/SE2016/000039, filed 7 Jul. 2016, that claims priority from Swedish Patent Application No. 1530106-2, filed 7 Jul. 2015.

TECHNICAL FIELD

The present disclosure generally relates to a support arrangement for supporting a dinghy. In particular, a support arrangement for supporting a dinghy on a carrier boat and a boat comprising the support arrangement are described.

BACKGROUND

Various solutions exist for lifting a dinghy onboard a carrier boat and for supporting the dinghy on the carrier boat. By lifting the dinghy out of the water and accommodating the dinghy onboard the carrier boat, more space is given to surrounding boats in a harbour and the dinghy can be protected from being scraped and crushed.

U.S. Pat. No. 5,113,783 A discloses a securing arrangement with two generally circular support rings for securing a dinghy to a boat. Each support ring is secured to a swim platform via a support arm and an attachment member. With this securing arrangement, after being lifted out of the water, the dinghy can be positioned such that the tapered rear end portions of the side pontoons project partially downwardly through the openings of the rings.

Although the securing arrangement of U.S. Pat. No. 5,113,783 A enables a support of the dinghy in an upright position on the boat, it is difficult to bring the dinghy into this position since the dinghy has to be lifted out of the water and positioned in the securing arrangement without any assistance from the securing arrangement.

SUMMARY

Accordingly, one object of the present disclosure is to provide a simple support arrangement with which a dinghy can be raised out of the water and into an upright storage position on a carrier boat in a simple and fast manner.

According to one aspect, a support arrangement for supporting a dinghy on a carrier boat is provided, where the support arrangement comprises a base structure for attachment to the carrier boat; and two carrying members, each for receiving a conical pontoon end of the dinghy, wherein the two carrying members are rotatably arranged with respect to the base structure such that the dinghy can be moved between a substantially horizontal orientation and an upright orientation with the conical pontoon ends received in the respective carrying member.

Throughout the present disclosure, the term "carrier boat" is used to denote the larger host boat or mother vessel, which is typically a sailboat or power boat. Cruisers, yachts, trawlers and other boats commonly employing a smaller boat or dinghy also constitute carrier boats according to the present disclosure.

The support arrangement is defined in connection with a dinghy having two conical pontoon ends. Although an inflatable dinghy with two rear conical pontoon ends might be the most common application for the support arrangement, the support arrangement works with any smaller boat having a shape to be received by the carrying members.

The base structure may be configured to be attached to a swim platform of the carrier boat. Alternatively, the swim platform may constitute a part of the base structure that is attached to the carrier boat. As a further alternative, a base structure without a swim platform may be attached to the carrier boat. Common for all these variants is that the base structure is attached to the stern side of the carrier boat.

The horizontal orientation is intended to denote an orientation substantially parallel with the sea surface. The upright orientation may include an angle of 60 to 120°, such as 90° (vertical orientation), to the horizontal orientation.

A rotational axis of the carrying member is the rotational axis about which the respective carrying member rotates when a conical pontoon end is received in the carrying member and rotated between the substantially horizontal orientation and the upright orientation. The rotational axes of the carrying members may coincide. Alternatively, the rotational axes of the carrying members may be offset and/or inclined with respect to each other.

Each carrying member may comprise a ring. For this reason, the support arrangement may also be referred to as "dinghy rings". The rings may have a generally circular appearance including a circular shape but also slightly oval shapes and any polygonal shape.

The rings may or may not have a closed peripheral extension. One or more openings along the peripheral extension of the rings may be present as long as the conical pontoon ends can be received therein and supported by the rings when the rings are oriented upwardly. Thus, the rings may be either closed or open. An open ring may for example have a U-shape.

The rings may have an opening slightly smaller than the main diameter of the pontoons of the dinghy. Thereby, when the conical pontoon ends of the dinghy are received in the rings and the dinghy adopts the upright orientation, the conical pontoon ends are fastened in the rings due to friction and/or a slight local deflation of the pontoon ends imposed by the weight of the dinghy. The weight of the dinghy may be in the range of 25 to 50 kg. However, the support arrangement may be dimensioned to handle dinghys with a weight of up to 100 kg.

The carrying members may or may not have a through opening. For example, in case the carrying members comprise rings, the carrying members may have a through opening. However, the carrying members may in addition to the rings also have a bottom structure substantially matching the shape of a conical pontoon end. Such carrying members may have a conical appearance where the ring is constituted by the base of the cone.

Each carrying member may comprise a rod member and the base structure may comprise a tubular member with two opposing openings for receiving the rod members in the opposite openings. Thus, the rod members may telescope in and out from the respective openings of the tubular member. The tubular member may have a square-formed outer profile. The inner profile of the tubular member may be circular. One or more bearings may be provided within the tubular member to rotationally support the rod members.

According to one realization, at least one of the rod members is connected to the base structure via a screw connection. Thus, by rotating the rod member, the rod member may be telescoped in and out from the respective opening of the tubular member. In case only one of the rod members is connected to the base structure via a screw connection, the other rod member may be longitudinally locked with respect to the base structure, e.g. by a bearing. The rod members may be rotationally locked to each other.

This may for example be accomplished by the provision of a guide pin on one rod member and a trace in the other rod member for guidingly receiving the guide pin.

As an alternative realization, the rod members may be connected to each other via a screw connection, i.e. one end of one rod member may be screwed into one end of the other rod member within the tubular member. One or more bearings may then be provided between the outer rod member and the tubular member to allow relative rotation therebetween.

The tubular member may be substantially straight and oriented substantially horizontal when attached to the carrier boat. For example, the tubular member may be oriented substantially parallel with a stern edge of the swim platform when attached to the carrier boat. The tubular member may be attached either above, below or astern of the swim platform.

The carrying members may be adjustable with respect to the base structure in a direction substantially coincident with their respective rotational axis. This may for example be realized by the telescopic action of the rod members within the tubular member. The support arrangement may further comprise a biasing member for biasing the carrying members towards each other in the direction substantially coincident with their respective rotational axis of the carrying members. The carrying members may be completely detached from the base structure when the support arrangement need not be used.

A friction arrangement may be provided between the rod members and the tubular member that reduces the play between the parts and increases the friction between the parts such that they stay in a desired relative position along the direction substantially coincident with their respective rotational axis. According to one variant, the friction arrangement is a rubber bushing between the tubular member and the rod member.

As an alternative, the carrying members may be adjustably attached to the base structure by brackets fixing the carrying members in a desired position along the respective rotational axis of the carrying members. In this case, the tubular member may be omitted.

The base structure may further comprise a telescoping structure for adjusting the carrying members towards or away from the carrier boat, e.g. in the forward and rearward travel direction, respectively, of the carrier boat. The telescoping structure may for example be constituted by two telescoping arms for attachment to the underside of a swim platform. With this variant, the carrying members may be adjusted between an exposed position behind (i.e. in the stern direction of) the swim platform and a hidden position where the entire support arrangement is hidden under the swim platform, as seen from above.

The base structure may comprise two separate attachment members for attachment to the carrier boat. For example the attachment members may be used to attach one carrying member at each lateral side of a swim platform. A lateral direction is a horizontal direction perpendicular to the travel direction of the carrier boat.

Each attachment member may comprise a hook member for engaging with a peripheral rod or bar on a swim platform of the carrier boat and an opposite supporting platform or plate member for engaging the underside of the swim platform. With this variant, the carrying members may be detachably attached to the swim platform.

According to a further variant, a boat comprising a support arrangement according to the present disclosure is provided. The boat may comprise a swim platform. The swim platform may be attached to a stern side of the boat.

According to a further variant, a swim platform for a boat comprising a support arrangement according to the present disclosure is provided.

BRIEF DESCRIPTION OF THE DRAWINGS

Further details, advantages and aspects of the present disclosure will become apparent from the following embodiments taken in conjunction with the drawings, wherein.

DETAILED DESCRIPTION

Figure 1A:
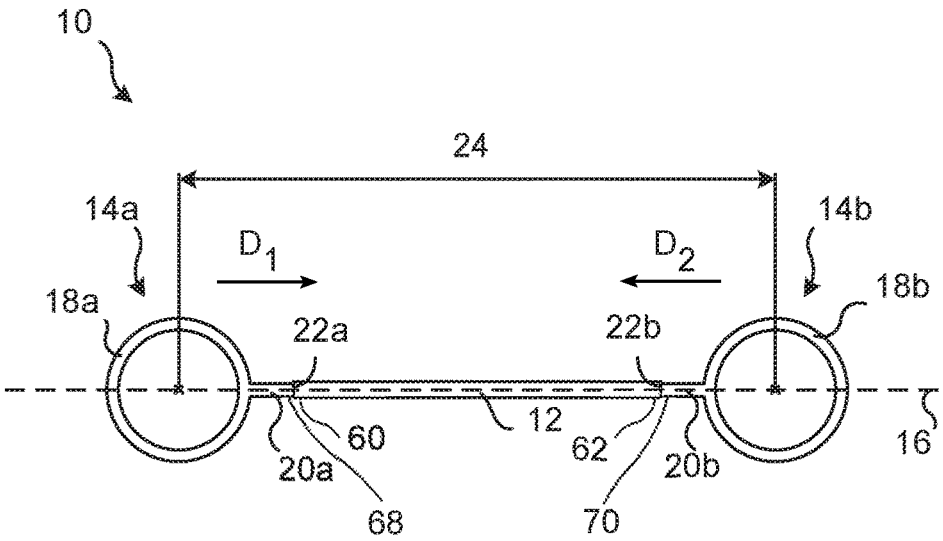
FIG. 1*a*: shows a top view of a support arrangement.

In the following, a support arrangement for supporting a dinghy and a boat comprising the support arrangement will be described. The same reference numerals will be used to denote the same or similar structural features.

Structural Description

Figure 1B:
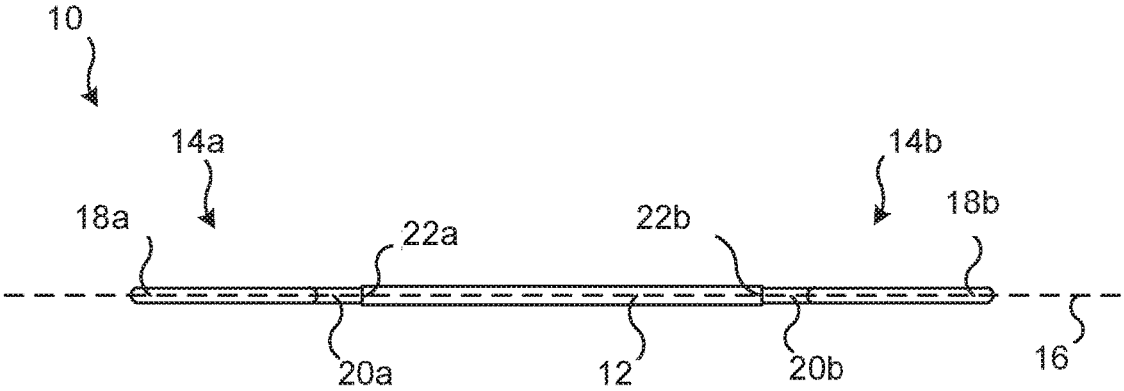
FIG. 1*b*: shows a side view of the support arrangement in FIG. 1*a;*

With reference to FIGS. 1*a* and 1*b*, FIG. 1*a* shows a top view of a support arrangement 10 and FIG. 1*b* shows a side view of the support arrangement 10. The support arrangement 10 comprises a base structure in the form of a tubular member 12 and a first ring-shaped carrying member 14*a* and a second ring-shaped carrying member 14*b* rotatably arranged with respect to the tubular member 12. Each carrying member 14*a*, 14*b* is rotatable about a longitudinal axis 16 of the tubular member 12.

The tubular member 12 is intended to be fastened to a stern region of a carrier boat (not shown), for example to a swim platform of the carrier boat. Any fastening arrangement may be used for this purpose. The tubular member 12 has a square-formed outer profile, i.e. its outer cross-sectional contour has the shape of a square.

Each carrying member 14*a*, 14*b* comprises a ring 18*a* and a ring 18*b* and a first rod member 20*a* and a second rod member 20*b*, respectively. The first rod member 20*a* extends radially outwardly in a first direction D1 from the first carrying member 14*a*. The second rod member 20*b* extends radially outwardly in a second direction D2 from the second carrying member 14*b*. The first direction D1 is opposite the second direction D2. The rings 18*a* and 18*b* and the rods members 20*a* and 20*b* are formed from a pipe. The thickness of the pipe may be 25 mm. The pipe may be of stainless steel. Each ring 18*a* and 18*b* is symmetrically (rotation symmetric) disposed with respect to the rod members 20*a* and 20*b*, respectively, i.e. an imaginary line of each rod member 20*a* and 20*b* extends through the center of each ring 18*a* and 18*b*. Each rod member 20*a* and 20*b* is also arranged in the same plane as the respective ring 18*a* and 18*b*.

The tubular member 12 is substantially straight and comprises a first opening 22*a* and a second opening 22*b* at its opposite ends first end 60 and second end 62 (along the longitudinal axis 16 of the tubular member 12). Each rod end 68 and 70 of rod member 20*a* and 20*b*, respectively is received in each opening 22*a* and 22*b*, respectively, in the tubular member 12.

Each rod member 20*a* and 20*b* may be telescoped in and out from the respective opening 22*a* and 22*b* in the tubular member 12. Dinghys commonly have a spacing (cc-spacing) 24 between its stern pontoon ends of 900 to 1100 mm. By telescoping the rod members 20*a* and 20*b* in or out from the respective opening 22*a* and 22*b* in the tubular member 12, the distance 24 between the centers of the rings 18*a* and 18*b* may be adjusted accordingly such that each pontoon end of the dinghy may be centered within a ring 18.

Although both rod members 20*a* and 20*b* in FIGS. 1*a* and 1*b* may be telescoped in and out from the respective opening 22*a* and 22*b* in the tubular member 12, the distance between the centers of the rings 18*a* and 18*b* may also be adjusted if only one of the rod members 20*a* and 20*b* can be telescoped and the other rod member 20 is longitudinally fixed to the tubular member 12. A fixed cc-spacing 24 between the centers of the rings 18*a* and 18*b* is also possible. A friction arrangement in the form of a rubber bushing (not shown) is provided between the tubular member 12 and each rod member 20*a* and 20*b*. The rubber bushing allows relative rotation between the rod members 20*a* and 20*b* and the tubular member 12 and adds friction to the displacement of the rod members 20*a* and 20*b* along the longitudinal axis 16 of the tubular member 12.

A biasing member (not shown) in the form of a rubber band interconnects the ends of each rod member 20 opposite to the respective ring 18. Thereby, the rod members 20 are held within the tubular member 12 and relative longitudinal displacement therebetween is allowed for adjusting the width between the rings 18. A loop (not shown) is provided at one end of each rod member 20 for fastening the biasing member to the rod members 20. The loops may be replaced with bolts or any structure for attaching the biasing member. The carrying members 14 may be completely detached from the tubular member 12. In case a biasing member is used, the detachment includes separating the biasing member from the rod members 20.

Figure 2:
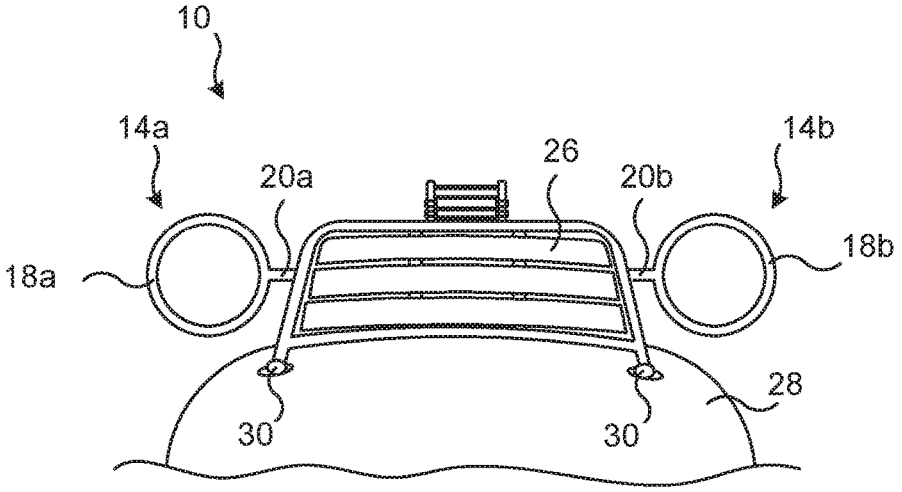
FIG. 2: shows a top view of the support arrangement in FIGS. 1*a* and 1*b* attached to a swim platform.

FIG. 2 shows a top view of the support arrangement 10 in FIG. 1 attached to a swim platform 26. The swim platform 26 is mounted to a stern region of a carrier boat 28. Two connections 30 between the swim platform 26 and the carrier boat 28 are visible in FIG. 2. The width between these connections is 840 mm.

The support arrangement 10 is attached to the swim platform 26 by screw connections between the tubular member 12 (not shown) and the underside of the swim platform 26. In FIG. 2, the carrying members 14 are positioned in an upright position, i.e., the rings 18 are oriented with their extension planes substantially horizontal.

Figure 3:
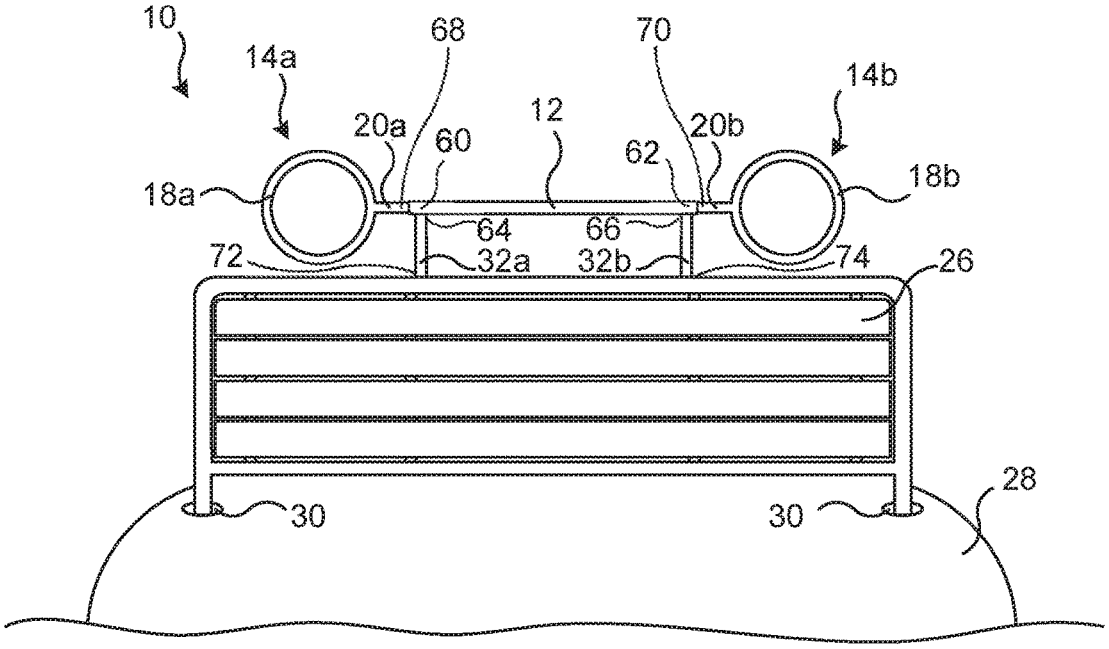
FIG. 3: shows a further support arrangement connected to a swim platform.

FIG. 3 shows a further support arrangement 10 connected to a swim platform 26 at a stern region of a carrier boat 28. As can be seen in FIG. 3, the swim platform 26 is wider (in the lateral direction, parallel to the travel direction of the carrier boat 28) than the swim platform 26 in FIGS. 1 and 2. The swim platform 26 in FIG. 3 has a distance between the connections 30, and a width, of 1500 mm.

The support arrangement 10 in FIG. 3 comprises the same carrying members 14 as in FIGS. 1 and 2. The tubular member 12 may be the same as in FIGS. 1 and 2. However, in FIG. 3, the tubular member 12 does not need any fastening arrangement for attachment to the swim platform 26. Instead, the support arrangement 10 in FIG. 3 comprises a telescoping structure in the form of a first telescoping arm 32*a* and a second telescoping arm 32*b* protruding outwardly from the swim platform 26. The telescoping arms 32*a* and 32*b* are attached to the underside of the swim platform 26. However, the telescoping arm 32*a* may alternatively be have a second end portion 72 attached to the carrier boat 28 and the telescoping arm 32*b* has a second end portion 74 attached to the carrier boat 28. The telescoping arm 32*a* has a first end portion 64 and the telescoping arm 32*b* has a first end portion 66 attached to the tubular member 12.

With the telescoping arms 32*a* and 32*b*, the carrying members 14 may be adjusted towards or away from the carrier boat 28. Since the swim platform 26 is provided at the stern region of the carrier boat 28, the direction towards the carrier boat 28 substantially corresponds to the forward travel direction of the carrier boat 28.

FIG. 3 illustrates the support arrangement 10 in an exposed position where the carrying members 14 are at the stern side of the swim platform 26. From the exposed position, the carrying members 14 and the tubular member 12 may be moved (e.g. pushed) by collapsing the telescoping arms 32*a* and 32*b* to a hidden position (not shown) where the carrying members 14 are hidden under the swim platform 26. In the hidden position, the entire support arrangement 10 is positioned within the outer periphery of the swim platform 26, as seen from above. The telescoping arms 32*a* and 32*b* may be locked in the exposed position and in the hidden position, for example with a springingly biased pin.

Figure 4A:
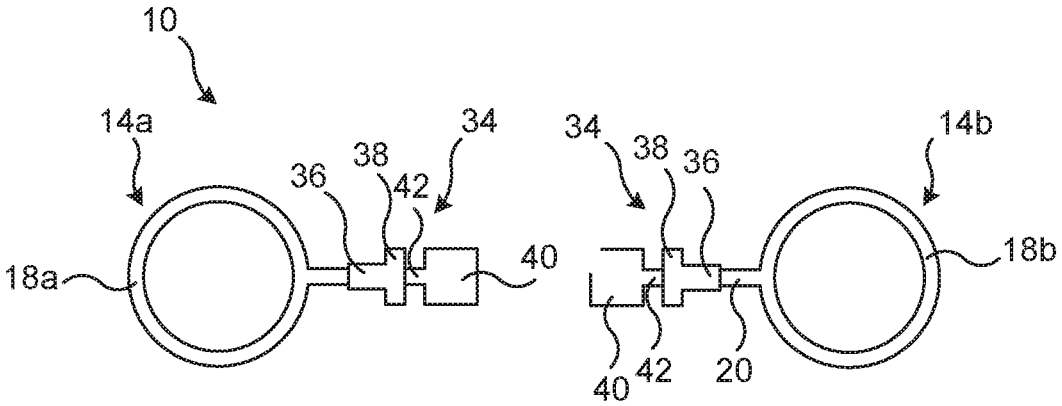
FIG. 4*a*: shows a top view of a further support arrangement.
Figure 4B:
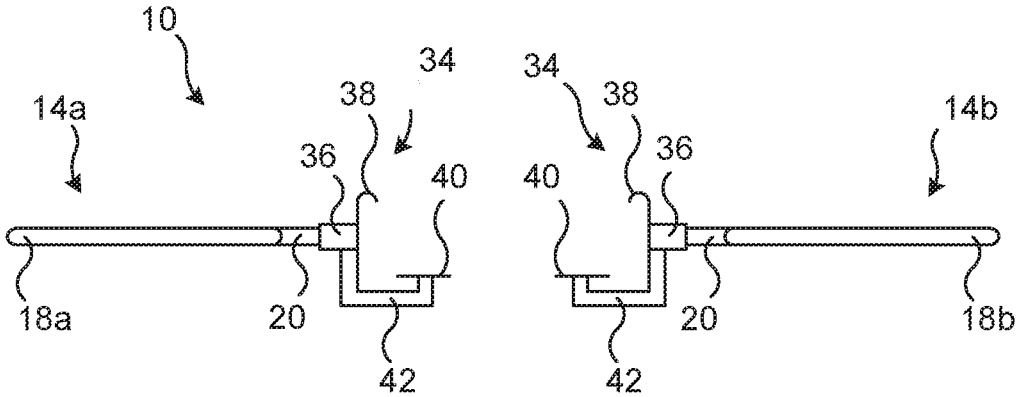
FIG. 4*b*: shows a side view of the support arrangement in FIG. 4*a*.

With reference to FIGS. 4*a* and 4*b*, a further support arrangement 10 is shown. FIG. 4*a* shows a top view of the support arrangement 10 and FIG. 4*b* shows a side view of the support arrangement 10. The support arrangement 10 comprises two carrying members 14, each with a ring 18 and a rod member 20. However, the base structure in FIGS. 4*a* and 4*b* comprises two separate attachment members 34. Each attachment member 34 is configured to be attached to the swim platform 26 of the carrier boat 28. The attachment members 34 are also configured to allow rotation of the carrying members 14.

The respective attachment members 34 each comprises a tubular rod 36. The tubular rods 36 constitute blind holes, i.e. they are bottomed. Otherwise, the tubular rods 36 are of substantially the same appearance as the ends of the tubular member 12 in FIGS. 1 to 3. Apparently, in the support arrangement 10 in FIGS. 4*a* and 4*b*, there is no interaction between the rod members 20 through the tubular rods 36. Otherwise, the interaction between the rod members 20 and the respective tubular rods 36 may be the same as the interaction between the rod members 20 and the tubular member 12 in FIGS. 1 to 3. For example, a biasing member may be provided between the rod members 20 and the end of the respective tubular rod 36, opposite to the carrying members 14.

Each attachment member 34 comprises a hook member 38. The hook members 38 have a profile substantially corresponding to (e.g. slightly larger) than the peripheral rod on the swim platform 26. Thereby, the attachment members 34 may be hung onto this peripheral rod at opposite lateral sides of the swim platform 26. Each hook member 38 is provided on the tubular rod 36 at an opposite side with respect to the carrying member 14.

The respective attachment member 34 further comprises a plate member in the form of a supporting platform 40. By abutting on the underside of the swim platform 26, the supporting platform 40 gives support to the respective carrying member 14 by locking the carrying member 14 at a specific rotational position about a peripheral rod on the swim platform 26 onto which the hook member 38 is attached. A joining structure 42 on each attachment member 34, in FIGS. 4*a* and 4*b* realized as an arm, rigidly interconnects the respective supporting platform 40 and the tubular rod 36.

Screws connections (not shown) may be provided to secure the attachment members 34 to the swim platform 26, e.g. between the swim platform 26 and the supporting platform 40. Screw connections may also be employed in order to establish and adjust a play between the supporting platform 40 and the swim platform 26. Thereby, a desired rotational position of the carrying member 14 about the peripheral rod on the swim platform 26 can be set.

Figure 5:
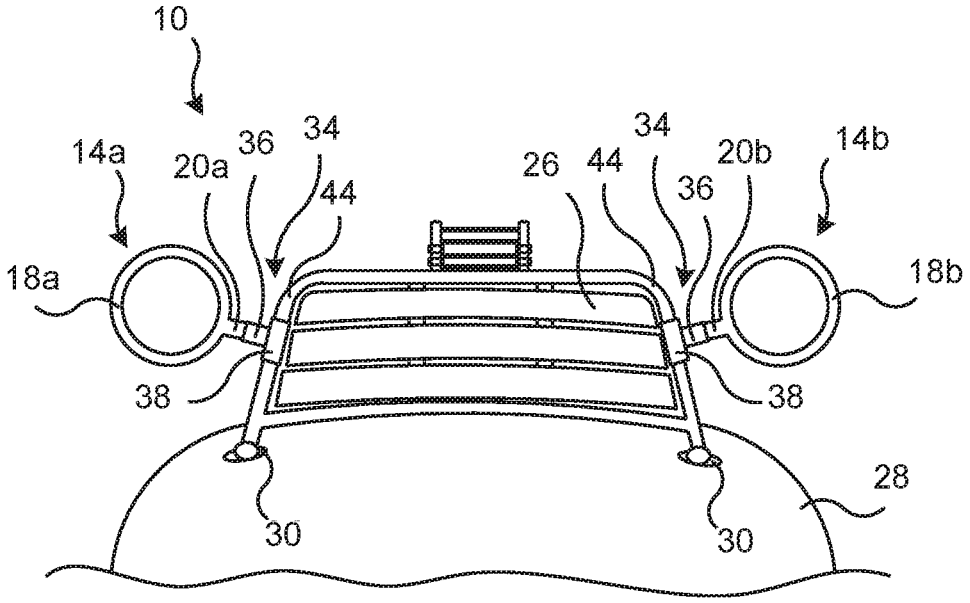
FIG. 5: shows a top view of the support arrangement in FIGS. 4*a* and 4*b* attached to a swim platform.

FIG. 5 shows a top view of the support arrangement 10 of FIGS. 4*a* and 4*b* attached to a swim platform 26 which is the same swim platform 26 as in FIG. 2. However, in FIG. 5, each carrying member 14 is attached to the swim platform 26 by hanging a hook member 38 onto the peripheral rod 44 of the swim platform 26.

As can be seen in FIG. 5, the two laterally opposing sides of the swim platform 26 are slightly inclined with respect to each other. Consequently, the rotational axes of the carrying members 14 are slightly inclined with respect to each other. However, the conical pontoon ends of the dinghy may still be received and held in the rings 18 when moving the dinghy between a substantially horizontal orientation and an upright orientation. There may however be a slight relative rotation between the pontoon ends and the respective ring 18 when the carrying members 14 are rotated.

Functional Description

In the following, a use of the support arrangement according to the present disclosure will be described.

When the dinghy is in the water, the dinghy may be guided, rowed or driven to the stern region of the carrier boat. After positioning the carrying members of the support arrangement in a vertical orientation, the width between the carrying members may be adjusted. With a proper adjustment, the load from the dinghy can be evenly distributed over the carrying members. The dinghy may be then guided such that its pontoon ends are inserted into carrying members. This guiding may for example be carried out by a person in the dinghy or by a person on the swim platform of the carrier boat.

By inserting the pontoon ends of the dinghy into the respective carrying member with a slight force, the position of the dinghy in the water may be locked in a horizontal orientation, for example due to friction and local deflation in the pontoon ends. The person may then grab a rope attached to the bow region of the dinghy. By standing on the swim platform or in the carrier boat and pulling the rope when the pontoon ends of the dinghy are received in the carrier members, the dinghy is rotated along with the carrying members from the horizontal orientation to the upright orientation. Thus, the entire lifting movement is accomplished with a single rotating action. The support arrangement also carries a major part of the dinghy load during this lift.

The dinghy may then be secured in the upright orientation, for example by leaning the dinghy to a wall of the carrier boat and/or by tying the rope to the carrier boat. In case a sailing boat is used, the dinghy may be leaned to the backstay. In this upright position, the dinghy only requires a small space on the carrier boat and will not be filled with rainwater.

When the dinghy should be used again, the person may simply untie the rope and let the dinghy rotate by gravity from the upright orientation to the horizontal orientation in the water by rotation of the carrying members in the support arrangement. If the dinghy does not come loose from the support arrangement in the horizontal orientation, a slight push on the dinghy is sufficient for loosening the dinghy.

Since the support arrangement may be adapted to a wide range of carrier boats, it constitutes a universal fitting for carrier boats.

While the present disclosure has been described with reference to exemplary embodiments, it will be appreciated that the present invention is not limited to what has been described above. Accordingly, it is intended that the present invention may be limited only by the scope of the claims appended hereto.

In the claims, any reference signs placed between parentheses shall not be construed as limiting the claim. Use of the verb "comprise" and its conjugations does not exclude the presence of elements or steps other than those stated in a claim. The article "a" or "an" preceding an element does not exclude the presence of a plurality of such elements. The mere fact that certain measures are recited in mutually different dependent claims does not indicate that a combination of these measures cannot be used to advantage.

While the present invention has been described in accordance with preferred compositions and embodiments, it is to be understood that certain substitutions and alterations may be made thereto without departing from the spirit and scope of the following claims.

I claim:

1. A support arrangement attached to a carrier boat, the support arrangement comprising:

a tubular member, the tubular member having a first opening defined therein at a first end of the tubular member and a second opening defined therein at a second end of the tubular member, the first end being opposite the second end of the tubular member, the tubular member having a first end portion of a first telescoping arm attached thereto at the first end of the tubular member and a first end portion of a second telescoping arm attached thereto at the second end of the tubular member, the first telescoping arm having a second end portion attached to a swim platform located at a stern region of the carrier boat, the second telescoping arm having a second end portion attached to the swim platform so that the first and second telescoping arms protrude outwardly from the swim platform; and a first ring-shaped carrying member having a first rod member extending radially outwardly in a first direction D1 from the first carrying member, the first rod member having a first outer end being attached to the first end of the tubular member; and a second ring-shaped carrying member having a second rod member extending radially outwardly in a second direction D2 from the second carrying member, the second rod member having a second outer end being attached to the second end of the tubular member, the first direction D1 being opposite the second direction D2.

2. The support arrangement according to claim 1, wherein the tubular member has two opposing openings defined therein for receiving the first rod member and second rod members-, respectively.

3. The support arrangement according to claim 1, wherein the carrying members are adjustable with respect to the tubular member.

4. The support arrangement according to claim 1, wherein the carrying members and the tubular member are movable towards and away from the swim platform of the carrier boat with the first and second telescoping arms.

* * * * *